US006024280A

United States Patent [19]

Marovskis

[11] Patent Number: 6,024,280

[45] Date of Patent: Feb. 15, 2000

[54] GABLE-TOP CONTAINERS AND CONTAINER BLANKS

[75] Inventor: Harry Marovskis, Plymouth, Minn.

[73] Assignee: Tetra Laval Holdings & Finance, S A, Pully, Switzerland

[21] Appl. No.: 08/763,700

[22] Filed: Dec. 9, 1996

[51] Int. Cl.[7] ..... B65D 5/42

[52] U.S. Cl. ..... 229/249; 229/3.1; 229/137

[58] Field of Search ..... 229/3.1, 137, 125.42, 229/123.2, 123.3, 249

[56] References Cited

U.S. PATENT DOCUMENTS

| | | | |
|---|---|---|---|
| Re. 26,305 | 11/1967 | Huang et al. | 229/249 |
| 2,575,544 | 11/1951 | Zinn, Jr. . | |
| 3,116,002 | 12/1963 | Crawford et al. | 229/249 |
| 3,675,015 | 7/1972 | Geib | 229/249 |
| 4,321,404 | 3/1982 | Williams et al. | 560/115 |
| 4,744,467 | 5/1988 | Jonsson et al. . | |
| 4,775,096 | 10/1988 | Andersson et al. | 229/125.42 |
| 4,801,078 | 1/1989 | Carlsson | 229/123.2 |
| 4,903,891 | 2/1990 | Gordon | 229/125.42 |
| 4,978,726 | 12/1990 | Dohler et al. | 525/479 |

*Primary Examiner*—Gary E. Elkins
*Attorney, Agent, or Firm*—Michael A. Catania

[57] ABSTRACT

A gable-top vessel made from sheet material having a heat-sealable surface is disclosed. The closure has at least one abhesive layer disposed between and joining the inner surfaces of the first and second outer rib panels to define a pair of joined panels. In one embodiment, the abhesive is applied at least adjacent to the top edges of the outer rib panels which are joined. The abhesive layer can be a copolymer of ethylene and acrylic acid or vinyl alcohol. The abhesive layer substantially hermetically seals the joined panels together whicle reducing the force required to part the joined panels, compared to the force which would be required to part the joined panels if the same panels were heat-sealed directly together in the same sealing regions without the abhesive. A method of assembling a filled and sealed gable-top container is also disclosed. Before or after the sheet material is cut or creased, at least one abhesive layer as described above is applied to at least one of the surfaces which are joined to seal the closure. The blank is then folded, filled and heat sealed to form a closed, essentially hermetically sealed, unitary top rib.

9 Claims, 4 Drawing Sheets

GABLE-TOP CONTAINERS AND CONTAINER BLANKS

TECHNICAL FIELD

The present invention relates in general to gable-top containers and the blanks from which they are formed. The invention relates more particularly to such containers which are made from heat-sealable sheet material which is bonded and sealed to various degrees in certain areas of the container closure.

BACKGROUND

Gable-top containers or containers are used widely for packaging milk, juices, and other liquid foods, as well as a variety of other food and non-food products. Such containers are often made from sheet material which is heat-sealable to itself. A typical material for gable-top containers is paper board coated on both sides with polyethylene (typically LDPE) or other heat-sealable material.

Completed gable-top cartons are typically adapted to be resealably opened along a top seal or fin. However, it is not uncommon for the heat seal between the LDPE layers to be stronger than the paper board substrate itself. Often, when the carton is opened, the paper tears away from the LDPE layers, or "delaminates", along the seal area.

Delamination usually occurs on or within the mouth of the spout, which is in or near contact with the contents of the package when the contents are poured out. The fibrous, torn surface of the spout is unsightly, and can be unsanitary if food in the container collects on the torn surface as the container is emptied.

In some gable-top cartons, abhesive areas are provided to reduce area of the heat-sealed surfaces. When abhesives are used, the sealing areas are reduced without requiring the sealing machine to narrowly focus the heat-seals, and delamination is greatly reduced.

One problem with conventional abhesives is that they hinder or prevent the formation of a proper fluid seal. This is of particular importance when the material to be packaged requires an hermetic seal, which reduces the transfer of oxygen and other gases, as well as liquids, through the sealed area. In known packages, a partial heat seal is required in addition to the abhesive seal, in order to affect hermetic sealing. The problem of delamination thus is confined to a smaller area, but not eliminated with conventional abhesives.

The conventional gable-top container also presents other functional or manufacturing problems. To allow proper container sealing, the abhesive areas must be precisely placed to leave a sealable margin. The thickness, viscosity, and choice of the abhesive must also be controlled so the abhesive will be effective within its intended boundaries without migrating and acting outside of those boundaries to any significant degree.

The need for precise application of a partial coating such as an abhesive on a substrate makes the application more expensive and difficult, or subjects the filled containers to a higher than desired seal failure rate. Reduction of the abhesive areas to provide a greater margin for migration and variable application increases the size of the torn heat-sealed surface.

The need for abhesives has also been reduced by confining the heat sealing region closely to parts of the inner surface of the carton, instead of (or in addition to) using the abhesives. Again, however, it is difficult to precisely confine ultrasonic, radiant, or conductive heating with a high degree of accuracy and reproducibility, so either the cost and difficulty of operating such equipment increases or the ability to provide a container with highly reproducible opening characteristics suffers.

If conventional polyethylene-coated heat-sealed containers are sealed in confined areas without using abhesives, the sealing temperature must be maintained within a range of a few degrees Fahrenheit (less than 2° C.) to provide sealing integrity without rendering the sealed container difficult to open or subject to delamination. This narrow temperature range is difficult to maintain in production machinery. Deviations from this range result in over- or under-sealed containers. The containers must be over-sealed to some degree to ensure that all are adequately sealed.

SUMMARY OF THE INVENTION

The present invention provides a solution to the many problems associated with the sealing of gable-top cartons. The present invention is able to accomplish this by providing a gable-top carton and blank having abhesive coating layers at specified locations for the facilitated opening of cartons without delaminating or tearing of any surfaces of the spout.

One aspect of the present invention is a blank adapted to form a closed gable-top vessel. The blank comprises a first outer rib panel, a second outer rib panel, a first inner rib panel, a second inner rib panel and an abhesive coating. The first outer rib panel has an inside surface, a closure side edge, top and bottom edges, and a first sealing region on its inside surface adjacent to its top edge. The second outer rib panel has an inside surface, a closure side edge and top and bottom edges, the inside surface of said second outer rib panel having a second sealing region adjacent to its top edge. The first inner rib panel has an inside surface, an outside surface, an outer edge joined by a crease to the closure side edge of the first outer rib panel, an inner edge, top and bottom edges, a third sealing region disposed on its inside surface, and a fourth sealing region disposed on its outside surface. The second inner rib panel has an inside surface, an outside surface, an outer edge joined by a crease to the closure side edge of the second outer rib panel, an inner edge joined by a crease to the inner edge of the first inner rib panel, top and bottom edges, a fifth sealing region disposed on its inside surface, and a sixth sealing region disposed on its outside surface. The abhesive coating is applied to a sealing region selected from the group consisting of the first sealing region, the second sealing region, the third sealing region, the fourth sealing region, the fifth sealing region, the sixth sealing region and any combination thereof. The abhesive coating may be composed of copolymers of ethylene moieties and at least one other chain component selected from the group consisting of acrylic acid moieties, vinyl alcohol moieties and combinations thereof.

Another aspect of the present invention is a blank formed from sheet material having a heat-sealable inside major surface. The blank is folded to form a closed gable-top vessel. The blank comprises at least one outer rib panel, at least one inner rib panel and an abhesive coating. The at least one outer rib panel has an inside surface, a closure side edge, top and bottom edges, and a first sealing region on its inside surface adjacent to its top edge. The at least one inner rib panel has an inside surface, an outside surface, an outer edge joined by a crease to the closure side edge of the at least one outer rib panel, an inner edge, top and bottom edges, and a second sealing region disposed on its inside surface. The abhesive coating is applied to at least one of the first sealing region and second sealing region for substantially hermetically sealing the first sealing region to the second sealing region when the gable-top vessel is closed. The abhesive coating provides for the facilitated openability of the gable-top vessel and the substantial elimination of delamination when the vessel is open.

The blank may further comprise a second outer rib panel, a second inner rib panel and a second abhesive coating. The second outer rib panel has an inside surface, a closure side edge and top and bottom edges, the inside surface of said second outer rib panel having a third sealing region adjacent to its top edge. The second inner rib panel has an inside surface, an outside surface, an outer edge joined by a crease to the closure side edge of the second outer rib panel, an inner edge joined by a crease to the inner edge of the first inner rib panel, top and bottom edges, and a fourth sealing region disposed on its inside surface. The second abhesive coating is applied to at least one of the third sealing region and fourth sealing region for substantially hermetically sealing the third sealing region to the fourth sealing region when the gable-top vessel is closed. The blank may further comprise a fifth sealing region disposed on the outside surface of the at least one inner rib panel, a sixth sealing region disposed on the outside surface of the second inner rib panel, and a third abhesive coating. The third abhesive coating is applied to at least one of the fifth sealing region and the sixth sealing region for substantially hermetically sealing the fifth sealing region to the sixth sealing region when the gable-top vessel is closed.

The first abhesive coating, second abhesive coating and third abhesive coating may consist essentially of a copolymer of ethylene and acrylic acid subsequent to drying. More specifically, the first abhesive coating, second abhesive coating and third abhesive coating may consist essentially of a copolymer of approximately 5 mol % to approximately 50 mol % acrylic acid moieties and approximately 50 mol % to approximately 95 mol % ethylene moieties. The first abhesive coating, second abhesive coating and third abhesive coating may consist essentially of a copolymer having a melt index of from about 300 to about 3000 subsequent to drying.

Another aspect of the present invention is a filled and sealed gable-top vessel made from sheet material having a heat-sealable inside surface and a gable-top closure. The gable-top closure comprises at least one outer rib panel, at least one inner rib panel and an abhesive coating. The at least one outer rib panel has an inside surface, a closure side edge, top and bottom edges, and a first sealing region on its inside surface adjacent to its top edge. The at least one inner rib panel has an inside surface, an outside surface, an outer edge joined by a crease to the closure side edge of the at least one outer rib panel, an inner edge, top and bottom edges, and a second sealing region disposed on its inside surface. The abhesive coating is applied to at least one of the first sealing region and second sealing region for substantially hermetically sealing the first sealing region to the second sealing region when the gable-top vessel is closed.

The gable-top closure may further comprise a second outer rib panel, a second inner rib panel and a second abhesive coating. The second outer rib panel has an inside surface, a closure side edge and top and bottom edges, the inside surface of said second outer rib panel having a third sealing region adjacent to its top edge. The second inner rib panel has an inside surface, an outside surface, an outer edge joined by a crease to the closure side edge of the second outer rib panel, an inner edge joined by a crease to the inner edge of the first inner rib panel, top and bottom edges, and a fourth sealing region disposed on its inside surface. The second abhesive coating is applied to at least one of the third sealing region and fourth sealing region for substantially hermetically sealing the third sealing region to the fourth sealing region when the gable-top vessel is closed. The gable-top closure may further comprise a fifth sealing region disposed on the outside surface of the at least one inner rib panel, a sixth sealing region disposed on the outside surface of the second inner rib panel, and a third abhesive coating. The third abhesive coating is applied to at least one of the fifth sealing region and the sixth sealing region for substantially hermetically sealing the fifth sealing region to the sixth sealing region when the gable-top vessel is closed.

The first abhesive coating, second abhesive coating and third abhesive coating may consist essentially of a copolymer of ethylene and acrylic acid. More specifically, the first abhesive coating, second abhesive coating and third abhesive coating may consist essentially of a copolymer of approximately 5 mol % to approximately 50 mol % acrylic acid moieties and approximately 50 mol % to approximately 95 mol % ethylene moieties. Even more specifically, the first abhesive coating, second abhesive coating and third abhesive coating may consist essentially of a copolymer of approximately 15 mol % to approximately 25 mol % acrylic acid moieties and approximately 75 mol % to approximately 85 mol % ethylene moieties. The first abhesive coating, second abhesive coating and third abhesive coating may consist essentially of a copolymer having a melt index of from about 300 to about 3000.

Still another aspect of the present invention is a method of assembling a gable-top container. The first step of the method is providing sheet material having a first surface and a second surface, one of which is a heat-sealable inside surface. The next step is cutting and creasing said sheet material to provide a blank. The blank comprises a first outer rib panel, a second outer rib panel, a first inner rib panel, a second inner rib panel and an abhesive coating. The first outer rib panel has an inside surface, a closure side edge, top and bottom edges, and a first sealing region on its inside surface adjacent to its top edge. The second outer rib panel has an inside surface, a closure side edge and top and bottom edges, the inside surface of said second outer rib panel having a second sealing region adjacent to its top edge. The first inner rib panel has an inside surface, an outside surface, an outer edge joined by a crease to the closure side edge of the first outer rib panel, an inner edge, top and bottom edges, a third sealing region disposed on its inside surface, and a fourth sealing region disposed on its outside surface. The second inner rib panel has an inside surface, an outside surface, an outer edge joined by a crease to the closure side edge of the second outer rib panel, an inner edge joined by a crease to the inner edge of the first inner rib panel, top and bottom edges, a fifth sealing region disposed on its inside surface, and a sixth sealing region disposed on its outside surface. The abhesive coating is applied to a sealing region selected from the group consisting of the first sealing region, the second sealing region, the third sealing region, the fourth sealing region, the fifth sealing region, the sixth sealing region and any combination thereof. The abhesive coating may be composed of copolymers of ethylene moieties and at least one other chain component selected from the group consisting of acrylic acid moieties, vinyl alcohol moieties and combinations thereof.

The next step of the method is squaring the blank to partially form the gable-top container with open ends. The next step is forming a bottom rib and a top rib of the gable-top container. The next step is filling the gable-top container with a desired contents such as milk. The final step is forming a second bottom rib and a second top rib of the gable-top container to provide a filled and sealed gable-top container.

Having briefly described the described this invention, the above and further objects, features and advantages thereof will be recognized by those skilled in the pertinent art from the following detailed description of the invention when taken in conjunction with the accompanying drawings.

BRIEF DESCRIPTION OF THE DRAWINGS

There is illustrated in FIG. 1 a perspective view of a fully assembled gable-top carton.

There is illustrated in FIG. 2 a view of the bottom of the gable-top carton of FIG. 1.

Figure 3:
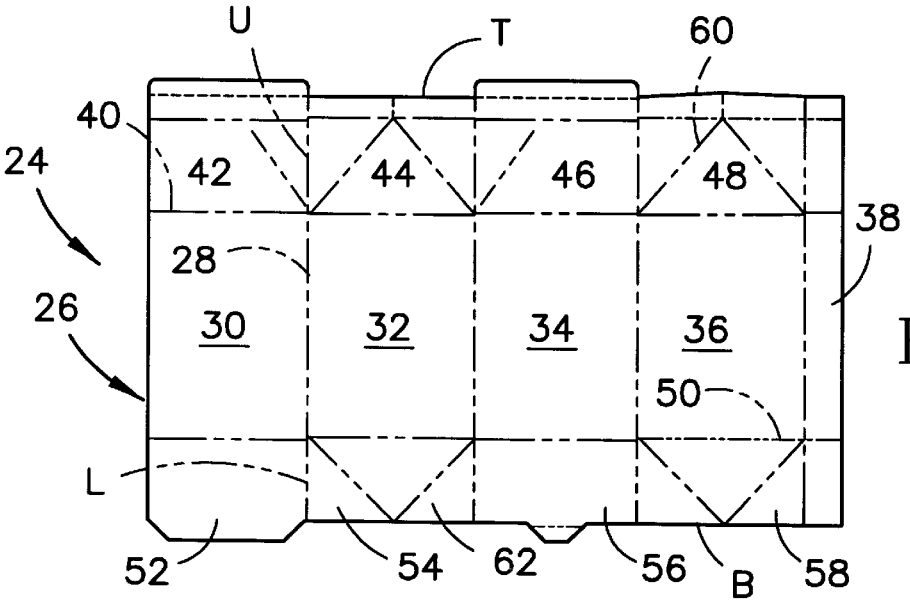

There is illustrated in FIG. 3 an outside surface plan view of a blank for a gable-top carton.

Figure 4:
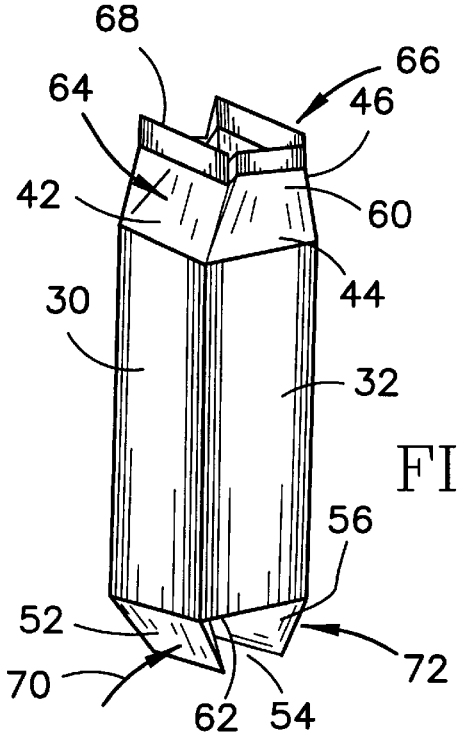

There is illustrated in FIG. 4 a perspective view of a partially assembled gable-top carton fabricated from the blank of FIG. 3.

Figure 5:
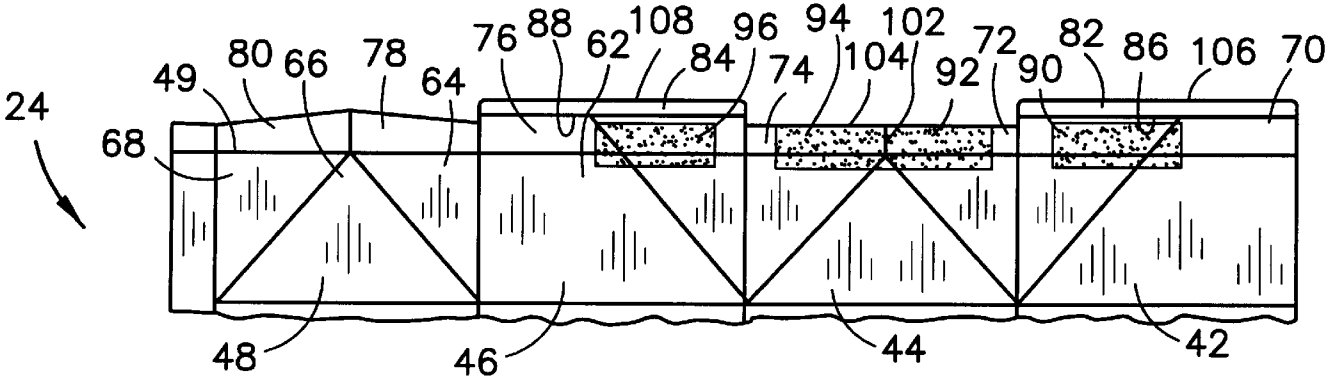

There is illustrated in FIG. 5 an inside surface plan view of one embodiment of a top of a container blank according to the present invention.

Figure 1:
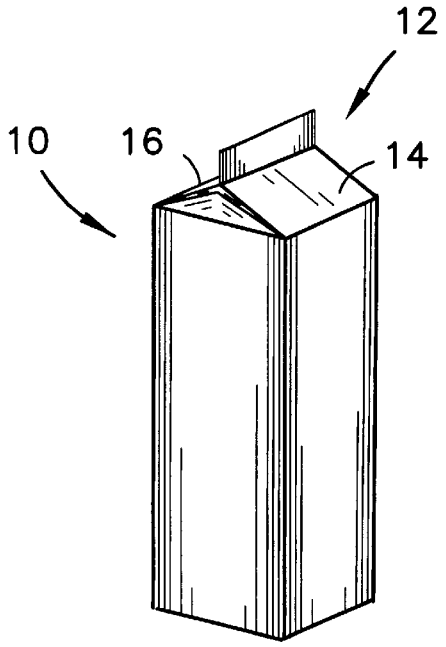
Figure 6:
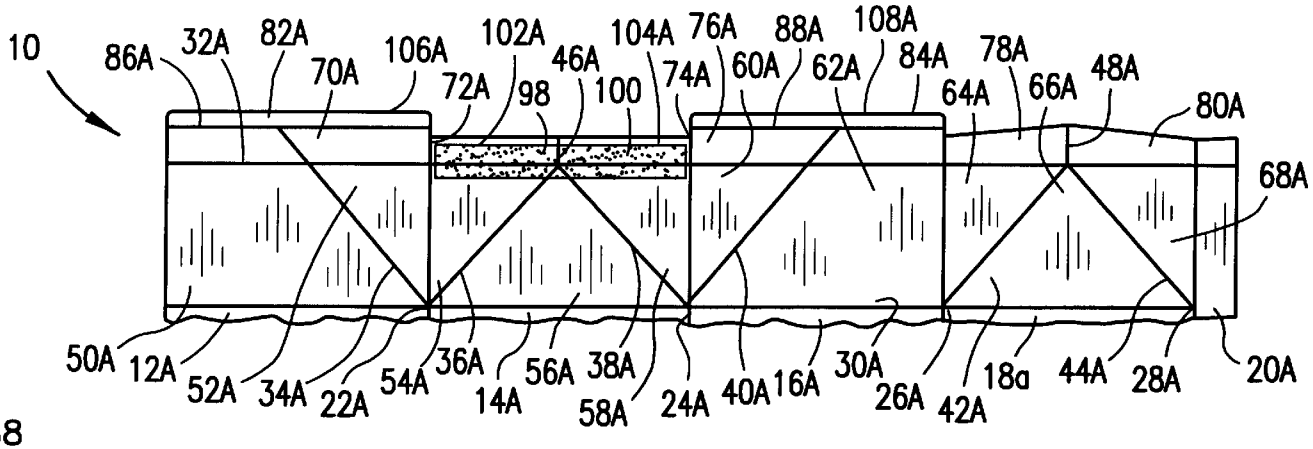

There is illustrated in FIG. 6 an outside surface plan view of the blank of FIG. 1.

Figure 7:
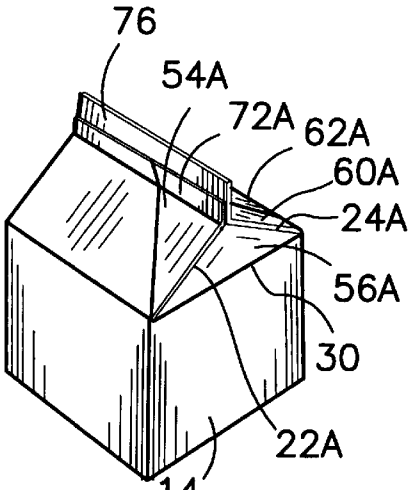

There is illustrated in FIG. 7 a perspective view of a closed gable-top container according to the present invention, with one outside rib panel and one inclined roof panel cut away to show underlying structure.

Figure 8:
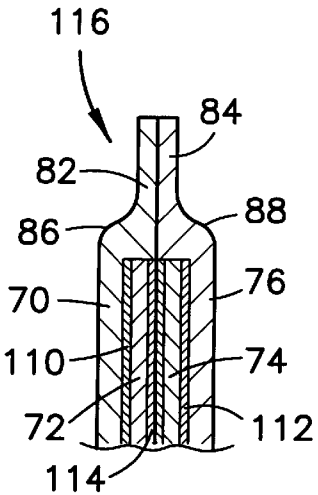

There is illustrated in FIG. 8 a fragmentary section taken along line 8—8 of FIG. 7.

Figure 9:
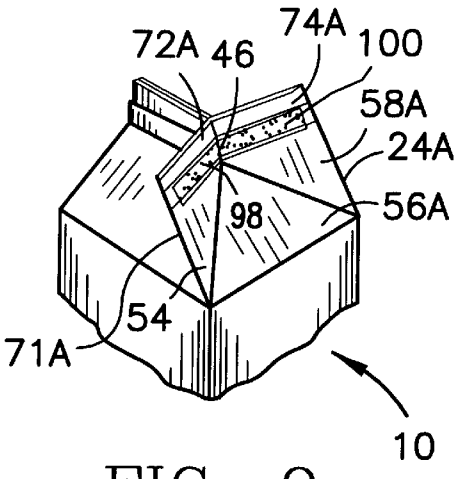

There is illustrated in FIG. 9 a view similar to FIG. 7, showing the container partly opened.

Figure 10:
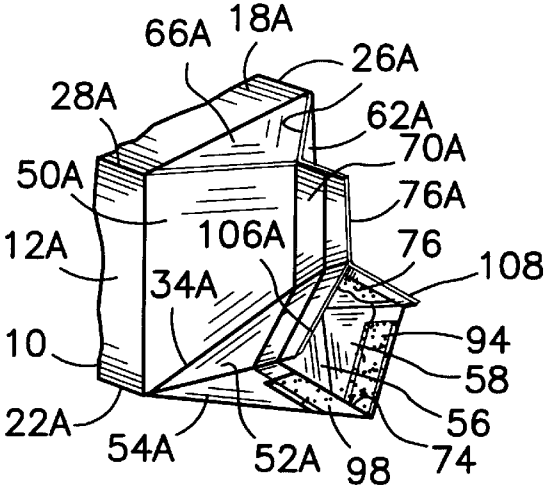

There is illustrated in FIG. 10 a view similar to FIG. 7, showing the container fully opened, deploying its spout.

Figure 11:
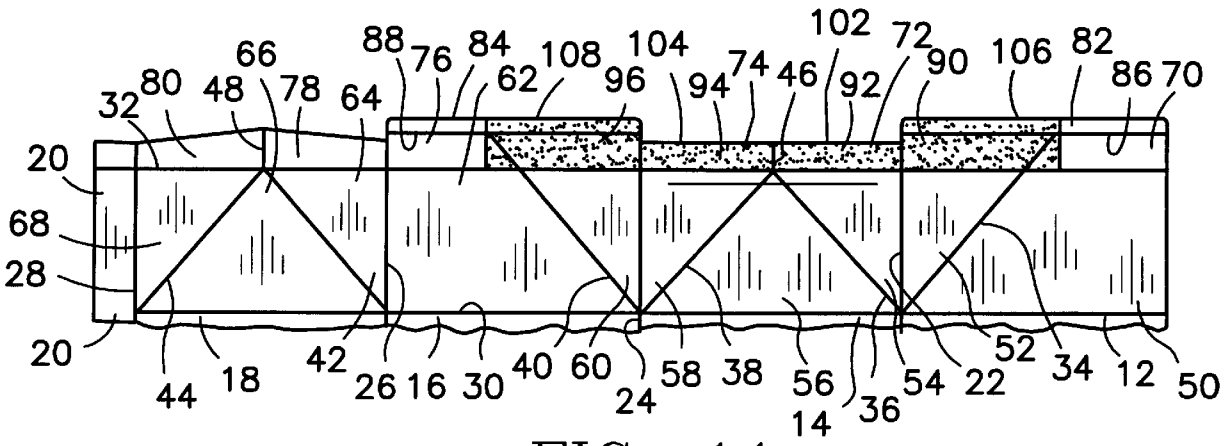

There is illustrated in FIG. 11 a fragmentary view similar to FIG. 5, showing a different pattern of application of an abhesive coating.

Figure 12:
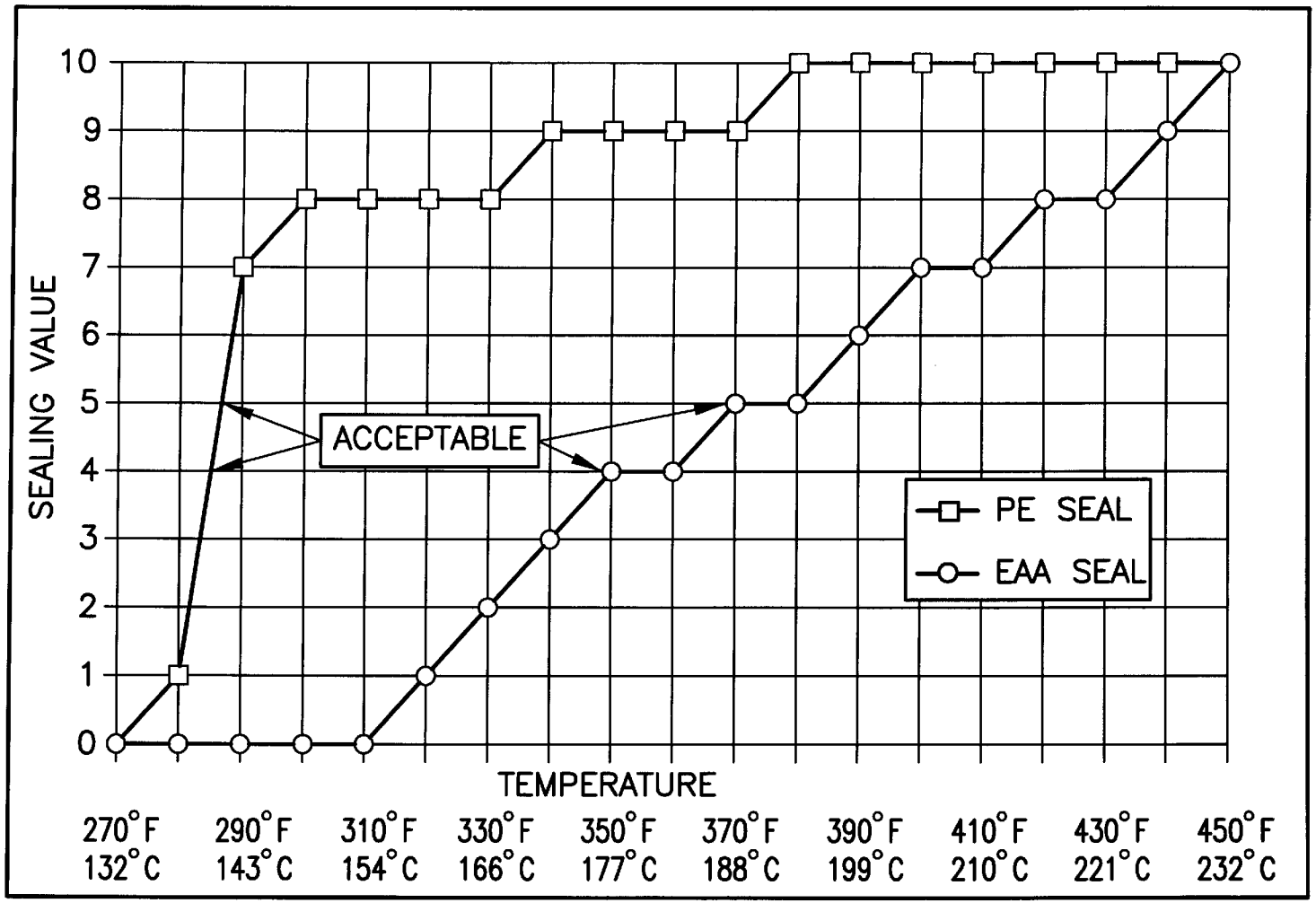

There is illustrated in FIG. 12 a plot of temperature versus sealing characteristics comparing the sealing performance of a heat-sealing machine when the sealed surfaces are unmodified polyethylene-coated paper board surfaces versus the same type of surfaces coated with an ethylene and acrylic acid copolymer.

DETAILED DESCRIPTION OF THE INVENTION

The present invention pertains to gable-top cartons and the blanks from which the cartons are formed. The construction and parts of such containers and the blanks from which they are formed are described and illustrated, for example, in U.S. Pat. No. 4,744,467, issued to Tetra Pak International AB, and U.S. Pat. No. 4,775,096, issued to AB Tetra Pak. Those entire patents are incorporated by reference here. The present invention builds upon those patents to provide a gable-top carton having abhesive coating layers at specified locations for the facilitated opening of cartons without delaminating or tearing of any surfaces of the spout. The present invention also reduces the necessity for precise placement of sealing materials and precise sealing conditions in a gable-top carton. The present invention further reduces the differences in seal properties which conventionally result from temperature variations in the sealing operation.

Figure 2:
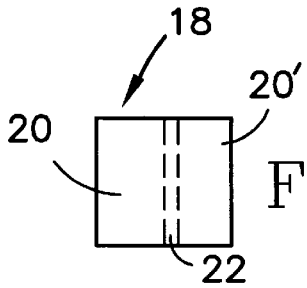

There is illustrated in FIG. 1 a perspective view of a fully assembled gable-top carton. There is illustrated in FIG. 2 a view of the bottom of the gable-top carton of FIG. 1. FIG. 1 illustrates a gable top carton 10 including a gable top 12 having a pair of converging gable sides 14, 16. The gable top carton 10 has a bottom surface 18, as shown in FIG. 2. The bottom surface 18 includes a pair of major flaps 20, 20' sealed along a bottom seal 22 that substantially bisects the bottom surface 18.

There is illustrated in FIG. 3 an outside surface plan view of a blank for a gable-top carton. A gable top carton such as that shown in FIG. 1 can be formed using a carton blank 24 of FIG. 3. The blank 24 includes a carton body 26 divided by a plurality of vertical creases 28. The vertical creases 28 extend from the top T to the bottom B of the carton blank, and separate the carton blank 24 into first (30), second (32), third (34), fourth (36), and fifth (38) vertical panels.

A horizontal top crease 40 extends substantially between the sides of the carton blank 24. The top crease 40 intersects with the vertical creases 28 define first (42), second (44), third (46), and fourth (48) top flaps between the horizontal top crease 40 and the top T of the carton blank 24, with the top flaps separated from one another by upper portions U of the vertical creases 28. A horizontal bottom crease 50 extends substantially between the sides of the carton blank 24 at a position between the bottom B of the carton blank 24. The bottom crease 50 intersects with the vertical creases 28 to define first (52), second (54), third (56), and fourth (58) bottom flaps between the horizontal bottom crease 50 and the bottom B of the carton blank 24. The bottom flaps are separated from one another by lower portions L of the vertical creases 28.

A series of top diagonal creases 60 are formed on the second top flap 44 and the fourth top flap 46 of the carton blank 24. The top diagonal creases 60 enable the second and fourth top flaps to be folded inwardly toward one another during carton formation, thus causing the first top flap 42 and third top flap 48 to become the gabled sides of the finished carton.

A series of bottom diagonal creases 62 are formed on the second bottom flap 54 and the fourth bottom flap 58 of the carton blank 24. The bottom diagonal creases 62 enable the second and fourth bottom flaps to be folded inwardly toward one another during carton formation, while the first bottom flap 52 and the third bottom flap 56 become the major flaps that form the bottom exterior surface of the finished carton.

There is illustrated in FIG. 4 a perspective view of a partially assembled gable-top carton fabricated from the blank of FIG. 3. The forming process for the carton blank 24 is schematically illustrated in FIG. 4. Force is applied to the top portion of the partially erected carton blank 24 in the direction of arrows 64 and 66 in such a way as to cause the top flap 44, along with the top flap 48 (not visible in FIG. 4) to fold inwardly toward one another, due to the diagonal creases 60. The top flap 42 and the top flap 46 thus form gable sides of the finished carton, sealed together at a top fin 68.

Force is also applied in the direction of arrows 70 and 72 to the bottom portion of the partially erected carton blank 24, thus causing the bottom flap 54, along with the bottom flap 58 (not visible in FIG. 4) to fold inwardly toward one another, due to the diagonal creases 62. The bottom flap 52 and the bottom flap 56 thus form major flaps of the finished carton, sealed together at a bottom seal 74.

There is illustrated in FIG. 5 an inside surface plan view of one embodiment of a container blank according to the present invention. There is illustrated in FIG. 6 an outside surface plan view of the blank of FIG. 5. As can be seen in FIG. 5, the blank 24 includes the top flaps 42, 44, 46 and 48. A second horizontal top crease 49 further defines the top flaps 42, 44, 46 and 48 into a series of rib panels. The top flap 42 has an outer rib panel 70. The top flap 44 has front inner rib panels 72 and 74. The top flap 46 has an outer rib panel 76. The top flap 48 has rear inner rib panels 78 and 80. Additionally, the top flaps 42 and 46 have top sealing portions 82 and 84 which are divided respectively from outer rib panels 70 and 76 by dividing lines 86 and 88.

Returning to outer rib panel 70, a first inner spout abhesive area 90 is located at a position for optimum sealing with a second inner spout abhesive area 92 located on the inner rib panel 72 while minimizing the use of an abhesive coating layer. The outer rib panel 76 has a third inner spout abhesive area 96 which is located at a position for optimum sealing with a fourth inner spout abhesive area 94 located on the inner rib panel 74 while minimizing the use of an abhesive coating layer. The second and fourth abhesive areas 92 and 94 extend to top edges 102 and 104 for inner rib panels 72 and 74, respectively. However, in this embodiment, the first and third abhesive areas 90 and 96 do not extend to the top edges 106 and 108 for the outer rib panels 70 and 76, respectively. The mating of the first abhesive area 90 with the second abhesive area 92, and the third abhesive area 96 with the fourth abhesive area 94 when the gable-top carton is closed, allows for the use of an abhesive coating layer on only one of each pair of abhesive areas if desired. The abhesive coating layer which may be applied to any of the abhesive areas is further described below.

As shown in FIG. 6, the outer surface elements corresponding to the inner surface elements shown in FIG. 5 have the same numeral designation except that the numeral designations for the outer surface elements are followed by an "A" as demonstrated by the outer surface top flap 42A corresponding to inner surface top flap 42. On the outer surface of the carton blank 24, only the outer surface of the inner rib panels 72A and 74A have abhesive areas which are designated fifth abhesive area 98 and sixth abhesive area 100. When the gable-top carton is closed, the fifth abhesive area 98 is disposed for mating with the sixth abhesive area 100.

The closure or top rib of a gable-top container is formed by overlapping and heat-sealing the side flap 20 on the margin of the side panel 12 and folding the container blank 10 to the configuration shown in FIGS. 7 and 8. Some parts of the container are better shown in FIGS. 9 and 10. As a result, the outer surfaces 72A and 74A of its front inner rib panels 72 and 74, and thus the outer spout abhesive areas 98 and 100 and the top edges 102 and 104, are juxtaposed. The inner surfaces of its outer rib panel 70 and front inner rib panel 72 and the inner surfaces of its front inner and outer rib panels 74 and 76 are also juxtaposed, which causes the inner spout abhesive areas 90 and 92, the inner spout abhesive areas 94 and 96, and the top edges 106 and 108 to be juxtaposed. The top sealing portions 82 and 84 of the outer rib panels 70 and 76 are juxtaposed. The juxtaposed pairs of abhesive areas 90 and 92, 94 and 96, and 98 and 100 can be thought of as merging to form integral abhesive coating layers 110, 112, and 114 as illustrated in FIG. 8. Finally, a fin 116 is created by the heat sealing of top sealing portions 82 and 84 (which may be done by heating, ultrasonic welding, or other means) while the outer rib panels 70 and 76 are urged together to close and seal the top of the package.

The abhesive layers 110, 112, and 114 interposed between portions of the outer and front inner rib panels 70 and 72, the front inner and outer rib panels 74 and 76, and the front inner rib panel outside surfaces 72A and 74A prevent the underlying surfaces from being heat-sealed together at all, or with a full-strength bond. The remaining juxtaposed panels of the gable-top closure, and particularly the parts of the panels 70, 72, 74, and 76 between and above the abhesive areas 90, 92, 94, 96, 98, and 100, are unaffected by the abhesive coating which is applied to these abhesive areas. Their polyethylene or similar thermoplastic surfaces bond together with full strength to seal the container shut. Typically, the abhesive areas 90, 92, 94, 96, 98 and 100 have been subjected to silicone oils or gums, waxes, or other materials before application of the abhesive coating which reduce the bonding strength essentially to nothing.

The container is opened in four stages, illustrated by comparing FIGS. 7, 9, and 10. There is illustrated in FIG. 7 a perspective view of a closed gable-top container according to the present invention, with one outside rib panel and one inclined roof panel cut away to show underlying structure. There is illustrated in FIG. 9 a view similar to FIG. 7, showing the container partly opened. There is illustrated in FIG. 10 a view similar to FIG. 7, showing the container fully opened, deploying its spout. First, the heat-sealed top sealing portions 82 and 84 of one half of the outer rib panels 70 and 76 above the inclined roof panels 64 and 66 must be parted by grasping the two wings defined by the front triangular fold-back panels 64A and 66A and breaking the bond between the top sealing portions 82 and 84 and the bond (if any) between the non-abhesive coated margins of the front inner rib panels 72A and 74A. Second, the two wings defined by the panels 64A and 66A are swung open about 180° or more, as illustrated in FIG. 9. Third, the side creases 28A and 28B are urged together and forward to buckle the pairs of panels 70, 72 and 74, 76, breaking the bonds between them. Fourth, the front triangular fold-back panels 64 and 66 and the front inner triangular end panel 60 are inverted to open a spout having a rhombic horizontal section.

A second embodiment of the invention is shown in FIG. 11, which is like FIG. 5 except for the choice of abhesive application areas. In FIG. 11, the abhesive coating application area is expanded substantially, versus FIG. 5. The areas 90, 92, 94, and 96 are merged to form a single abhesive coating layer which covers the entire panels 72 and 74 and corresponding parts of the panels 70 and 76. The abhesive coating layer also extends above the dividing lines 96 and 98 all the way to the top edges 104 and 108 of the panels 70 and 76. There is no longer any need to provide uncoated side margins between the areas 90 and 92, between the areas 94 and 96, and above the dividing lines 86 and 88 since these areas can be sealed by the abhesive coating layer.

The abhesive coating, subsequent to drying, in each embodiment may consist essentially of a material selected from copolymers of two ethylenically unsaturated monomers, in particular ethylene and at least one other chain component selected from the group consisting of acrylic acid moieties, vinyl alcohol moieties, and combinations thereof. When applied wet, the abhesive coating may consists of a copolymer, ammonia, water and other releasing additives. The abhesive coating layer, for example, may consist essentially of a copolymer of ethylene and acrylic acid subsequent to drying. One contemplated copolymer is from about 5 mol % to about 50 mol %, alternately from about 15 mol % to about 25 mol %, alternately about 20 mol %, acrylic acid moieties and from about 50 mol % to about 95 mol %, alternately from about 75 mol % to about 85 mol %, alternately about 80 mol % ethylene moieties. The preferred abhesives are branched polymeric chains having a melt index of from about 300 to about 3000, which is an indirect measure of their molecular weights. A melt index of about 300 for a 20% acrylic acid copolymer corresponds to a weight average molecular weight of 18,000 and a number average molecular weight of 7000.

Such abhesives are marketed commercially under the registered trademark PRIMACOR by The Dow Chemical Company, Midland, Mich. A specific material in this family which has been found to be useful is PRIMACOR 5990.

Another type of abhesive useful herein is a copolymer of ethylene and vinyl alcohol having similar molar ratios of its constituents and other properties as the ethylene and acrylic acid copolymers identified above. Terpolymers of ethylene, acrylic acid, and vinyl alcohol, in which the proportions of ethylene moieties are as previously stated and the proportions of the acrylic acid and vinyl alcohol moieties, combined, are the same as those of the acrylic acid moieties of the ethylene/acrylic acid copolymers discussed above, are also contemplated for use as the present abhesives.

The abhesives contemplated herein can be formulated with a variety of other materials, within the scope of the present invention. Fillers such as unmodified or amine modified clay, barium sulfate, barytes, carbon black, titanium dioxide, whiting, calcium carbonate, zinc oxide, colloidal silica, or combinations of these materials can be used. Colors, particularly inorganic pigments and organic pigments, can be used. Invisible dyes which can be detected under ultraviolet light can be used to verify the abhesive application areas. Releasing agent additives may also be employed to further enhance the openability of the carton.

Gums and thickeners can be incorporated in the present abhesives. Exemplary materials of this kind include ACRYSOL ASE (sold by Union Carbide), casein, hydroxyethylcellulose, guar gum, Karaya gum, methylcellulose, polyvinyl alcohol, starches, and the like.

Defoamers and lubricants can be used in these abhesive compositions. Exemplary materials of these kinds are colloidal silica, dioctyl phthalate, paraffin or other waxes (directly or as emulsions), ethylene glycol, propylene glycol, trioctyl phosphate, and 2-ethylhexanol.

Other materials which can be added include inorganic or organic alkalis for pH adjustment, melamine-formaldehyde resin, monovalent electrolytes, a styrene maleic half ester, and the sodium salt of styrene maleic acid.

The present abhesives may be dispersed in water to provide, for example, from about 10% to about 70% solids, optionally from about 14% to about 40% solids, in an aqueous solution. The dispersion may be prepared by heating the neat abhesive above its melting point and mixing or emulsifying it with water in the presence of an alkaline agent. If a fugitive alkali is desired, ammonia can be used. An organic or inorganic alkali can also be used, although if a substantial amount of non-volatile alkali remains in the final coating its resistance to penetration by water might be reduced. Other diluents useful herein include water-miscible and water-soluble solvents, for example alcohols, particularly isopropanol. Other organic solvents can be used, but are less preferred in an industrial setting than water or water-soluble materials.

The water dispersion can have the following exemplary properties at a standard temperature, such as 77° F. (25° C.): a solids level of from about 10% to about 50% by weight, a viscosity by Brookfield LVT of from less than about 60 cps (#1 spindle at 60 RPM) to at least 600 cps (#3 spindle at 60 RPM), a Zahn Cup viscosity of from less than 25 seconds (#2 cup) to more than 40 sec (#3 cup); and a pH of from about 7.5 or a little less to about 11.5 or more.

Specific abhesive formulations which are useful herein are sold by Michelman Inc., Cincinnati, Ohio, Mica Corporation, Stratford, Conn., Pierce & Stevens, Varitech Division and Findley Abhesives Inc., Wauwatosa, Wis.

The aqueous abhesive formulation is applied in a very thin layer, for example, less than a mil (0.025 mm. or 25$\mu$) thick, potentially less than 0.1$\mu$ thick, on heat-sealable gable-top container stock. Rotogravure, flexographic, or pad application equipment can be used for this purpose. The solvent is allowed to evaporate, which may be accomplished more quickly by heating the abhesive areas, to provide a dry coating. The abhesive may be applied before or after blanks are formed from the stock. The blanks are then used conventionally to make, fill, and seal containers.

EXAMPLE ONE

In independent trials, each of the manufacturers abhesive formulations is coated to a thickness of about 1 mil (25$\mu$), as shown in FIG. 7, on polyethylene-coated paperboard blanks. The containers are fabricated and heat sealed with conventional gable-top container fabricating equipment. As a control, samples of the same container blanks which are not coated with the abhesive are fabricated in the same manner as the abhesive-treated containers. Separate samples of each type of container are heat-sealed at temperatures ranging in ten-degree increments from 270° F. to 450° F. (132° to 232° C.).

FIG. 8 compares the results of sealing treated and untreated containers at various temperatures. The X-axis is sealing temperature and the Y-axis is a qualitative value scale in which the range from 4 to 5 set off in Table I below represents an optimal value. Higher and lower values are deviations from optimal representing a deficient seal (values of 1, 2, or 3) or excessive adhesion (values of 6, 7, 8, 9, or 10). The specific definitions for the value scale are set out in Table I.

The difference between practicing the present invention with and without the present abhesive is shown in FIG. 8. The polyethylene-coated material without the abhesive provides a much stronger seal at any given temperature, but only provides the optimal seal strength values of 4 to 5 in a temperature range of about 3° F. (less than 2° C.)—from about 284 to about 287° F. (140° to 142° C.). An acceptable degree of sealing is difficult to obtain using polyethylene-coated material without the present abhesive or an abhesive, since it is difficult to maintain the sealing temperature within three degrees (less than 2° C.) in commercial equipment.

The abhesive composition according to the present invention, represented by the lower curve, provides optimal sealing in an approximately 30° F. (17° C.) or greater range, from 350° to 380° F. (177 to 193° C.). The sealing temperature can readily be held within this range when the present invention is practiced. Thus, the opening force and tearing can be minimized without producing inadequately sealed containers.

TABLE I

| | Sealing Value Scale | | |
|---|---|---|---|
| VALUE | Degree of Seal | Ease of Opening | Fiber tear |
| 0 | None | Easy | None |
| 1 | Slight | Easy | None |
| 2 | Partial | Easy | None |
| 3 | Almost complete | Easy | None |
| 4 | Complete | Easy | None |
| 5 | Complete | Acceptable | None |
| 6 | Complete | Hard | None |
| 7 | Complete | Hard | Slight |
| 8 | Complete | Hard | Partial |
| 9 | Complete | Hard | Extensive |
| 10 | Complete | Hard | Total |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A blank formed from sheet material having a heat-sealable inside major surface, said blank being foldable to form a closed gable-top vessel, the blank comprising:

a first outer rib panel having an inside surface, a closure side edge, top and bottom edges, and a first sealing region on its inside surface adjacent to its top edge;

a first inner rib panel having an inside surface, an outside surface, an outer edge joined by a crease to the closure side edge of the at least one outer rib panel, an inner edge, top and bottom edges, a second sealing region disposed on its inside surface and a third sealing region disposed on its outside surface;

a second outer rib panel having an inside surface, a closure side edge and top and bottom edges, the inside surface of said second outer rib panel having a fourth sealing region adjacent to its top edge;

a second inner rib panel having an inside surface, an outside surface, an outer edge joined by a crease to the closure side edge of the second outer rib panel, an inner edge joined by a crease to the inner edge of the first inner rib panel, top and bottom edges, a fifth sealing region disposed on its inside surface, and a sixth sealing region disposed on its outside surface;

a first abhesive coating applied to at least one of the first sealing region and second sealing region which are substantially hermetically sealed when the gable-top vessel is closed;

a second abhesive coating applied to at least one of the fourth sealing region and fifth sealing region;

a third abhesive coating applied to at least one of the third sealing region and the sixth sealing region;

wherein the first abhesive coating, second abhesive coating and third abhesive coating each comprise a copolymer of ethylene and acrylic acid and wherein the first, second and third abhesive coatings providing for the facilitated openability of the gable-top vessel and the substantial elimination of delamination when the vessel is open.

2. The blank according to claim 1 wherein the first abhesive coating, second abhesive coating and third abhesive coating comprise a copolymer of approximately 5 mol % to approximately 50 mol % acrylic acid moieties and approximately 50 mol % to approximately 95 mol % ethylene moieties.

3. The blank according to claim 1 wherein the first abhesive coating, second abhesive coating and third abhesive coating comprise a copolymer of approximately 15 mol % to approximately 25 mol % acrylic acid moieties and approximately 75 mol % to approximately 85 mol % ethylene moieties.

4. The blank according to claim 1 wherein the first abhesive coating, second abhesive coating and third abhesive coating comprise a copolymer having a melt index of from about 300 to about 3000.

5. A filled and sealed gable-top vessel made from sheet material having a heat-sealable inside surface and a gable-top closure, the gable-top closure comprising:

a first outer rib panel having an inside surface, a closure side edge, top and bottom edges, and a first sealing region on its inside surface adjacent to its top edge;

a first inner rib panel having an inside surface, an outside surface, an outer edge joined by a crease to the closure side edge of the at least one outer rib panel, an inner edge, top and bottom edges, a second sealing region disposed on its inside surface and a third sealing region disposed on its outside surface;

a second outer rib panel having an inside surface, a closure side edge and top and bottom edges, the inside surface of said second outer rib panel having a fourth sealing region adjacent to its top edge;

a second inner rib panel having an inside surface, an outside surface, an outer edge joined by a crease to the closure side edge of the second outer rib panel, an inner edge joined by a crease to the inner edge of the first inner rib panel, top and bottom edges, a fifth sealing region disposed on its inside surface, and a sixth sealing region disposed on its outside surface;

a first abhesive coating applied to at least one of the first sealing region and second sealing region which are substantially hermetically sealed when the gable-top vessel is closed;

a second abhesive coating applied to at least one of the fourth sealing region and fifth sealing region;

a third abhesive coating applied to at least one of the third sealing region and the sixth sealing region;

wherein the first abhesive coating, second abhesive coating and third abhesive coating are composed of a copolymer of ethylene moieties and a second chain component selected from the group consisting of acrylic acid moieties, vinyl alcohol moieties, and combinations thereof, and wherein the first, second and third abhesive coatings providing for the facilitated openability of the gable-top vessel and the substantial elimination of delamination when the vessel is open.

6. The gable-top closure according to claim 5 wherein the first abhesive coating, second abhesive coating and third abhesive coating comprise a copolymer of ethylene and acrylic acid.

7. The gable-top closure according to claim 5 wherein the first abhesive coating, second abhesive coating and third abhesive coating comprise a copolymer of approximately 5 mol % to approximately 50 mol % acrylic acid moieties and approximately 50 mol % to approximately 95 mol % ethylene moieties.

8. The gable-top closure according to claim 5 wherein the first abhesive coating, second abhesive coating and third abhesive coating comprise a copolymer of approximately 15 mol % to approximately 25 mol % acrylic acid moieties and approximately 75 mol % to approximately 85 mol % ethylene moieties.

9. The gable-top closure according to claim 5 wherein the first abhesive coating, second abhesive coating and third abhesive coating comprise a copolymer having a melt index of from about 300 to about 3000.

* * * * *